United States Patent [19]

Levenberg

[11] Patent Number: 4,630,739

[45] Date of Patent: Dec. 23, 1986

[54] STATIONERY RACK CONSTRUCTION

[75] Inventor: Nat Levenberg, Lynbrook, N.Y.

[73] Assignee: Jefsteel Business Equipment Corp., Brooklyn, N.Y.

[21] Appl. No.: 786,224

[22] Filed: Oct. 10, 1985

[51] Int. Cl.[4] ..... A47F 5/00

[52] U.S. Cl. ..... 211/189; 211/11; 211/184; 211/194; 206/561

[58] Field of Search ..... 211/189, 126, 11, 194, 211/184; 206/558, 561; 220/23.6, 22, 23.4, 23.2

[56] References Cited

U.S. PATENT DOCUMENTS

| | | | |
|---|---|---|---|
| 2,934,215 | 4/1960 | Mogulescu et al. | 211/126 |
| 3,501,019 | 3/1970 | Armstrong et al. | 211/184 |
| 3,780,905 | 12/1973 | Herolzer | 211/126 X |
| 4,043,456 | 8/1977 | Howell | 211/184 |
| 4,248,349 | 2/1981 | Locke et al. | 206/561 X |

FOREIGN PATENT DOCUMENTS

| | | | |
|---|---|---|---|
| 873707 | 6/1971 | Canada | 211/126 |
| 2129679 | 5/1984 | United Kingdom | 211/126 |

*Primary Examiner*—Robert W. Gibson, Jr.
*Attorney, Agent, or Firm*—Charles E. Temko

[57] ABSTRACT

A synthetic resinous rack construction formed entirely from planar molded sections having resiliently flexible interlocking means to maintain the component parts in assembled condition. As contrasted with prior art metallic construction, interconnecting component parts results in immediate maintenance of correct mutual angular relation thereby facilitating the further assembly of the remaining component parts.

4 Claims, 12 Drawing Figures

STATIONERY RACK CONSTRUCTION

BACKGROUND OF THE INVENTION

This invention relates generally to the field of stationery racks and similar devices commonly used in offices or other places of business for intermediate filing and temporary storage of blank stationery, printed literature and forms which permit ease of assembly, capability for expansion and improved safety on the part of the assembler.

In the traditional construction of these devices, it is usual to form the component parts from stamped sheet metal, which parts are interconnected using bendable laterally extending edge located tabs into corresponding elongated openings to form a right angle interconnection between a floor member and a side wall member or a rear wall member. This type of interconnection, while fairly secure, is not rigid, and permits relative movement between the parts, once interconnected, so that further interconnection of the interconnected wall and floor members with other component members is difficult since it is necessary to maintain proper angularity between the interconnected parts in order to join them with other parts. The assembly procedure is further complicated by the ffact that metallic constructions from stamped sheet material are bordered by relatively sharp edges which tend to cut the fingers of the assembler unless great care is taken. Once the rack frame is assembled, it still lacks a desired degree of rigidity and requires either further bracing, or the insertion into an outer frame or housing, which frame requires nut and bolt assembly as well.

SUMMARY OF THE INVENTION

Briefly stated, the invention contemplates the provision of an improved stationery rack construction of the class described in which the above described disadvantages have been substantially eliminated.

To this end, the device is formed entirely of synthetic resinous, generally planar moldings which are provided with interlocking tab and expandable groove means, which, when interconnected, maintain a substantially constant angular orientation, so that planar members comprising the construction may be progressively assembled without difficulty, using only the hands of a single assembler. The materials from which the device is constructed permit limited flexing of the parts during assembly for this purpose. Because the parts are molded rather than stamped, the problem of sharp edges is totally eliminated, and if necessary, the device can be disassembled as easily as it is assembled. Several of the interconnecting means on the component parts are placed in non-symmetrical orientation and are engageable with different ones on members forming side walls, to permit, for example, floor forming members to be interconnected on either side of the side wall members in non-interfering relation to permit the formation of larger storage units capable of accomodating adjacently located stacks of storage material.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 2:
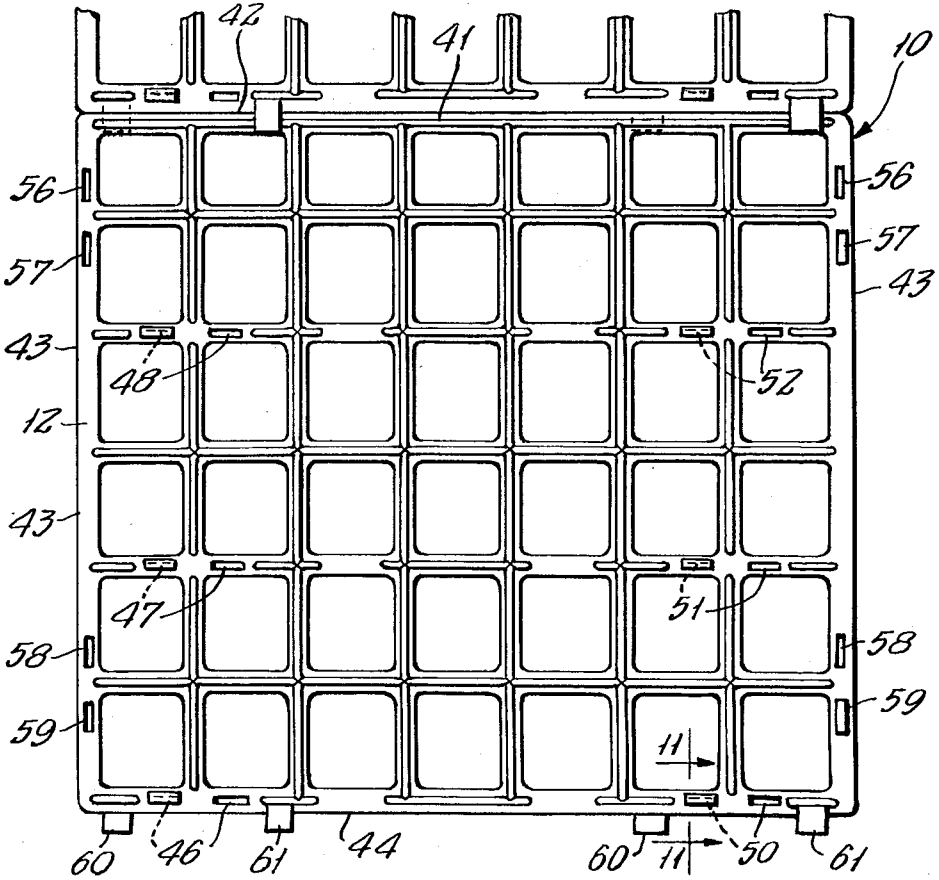
FIG. 2 is a fragmentary side elevational view thereof.
Figure 1:
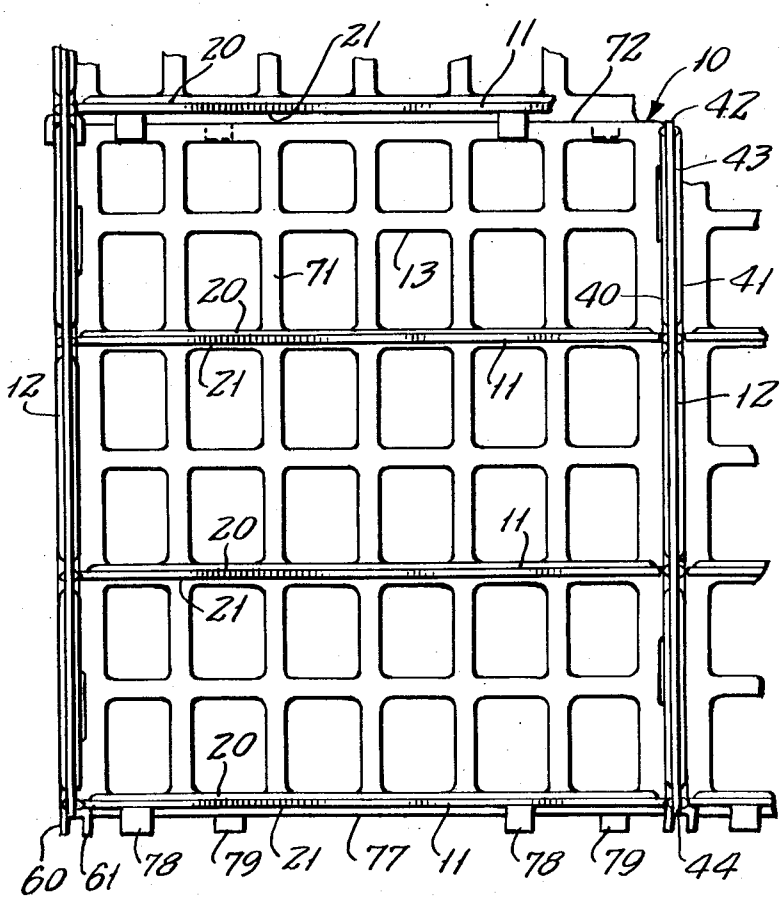
FIG. 1 is a fragmentary front elevational view of the embodiment of the invention.
Figure 4:
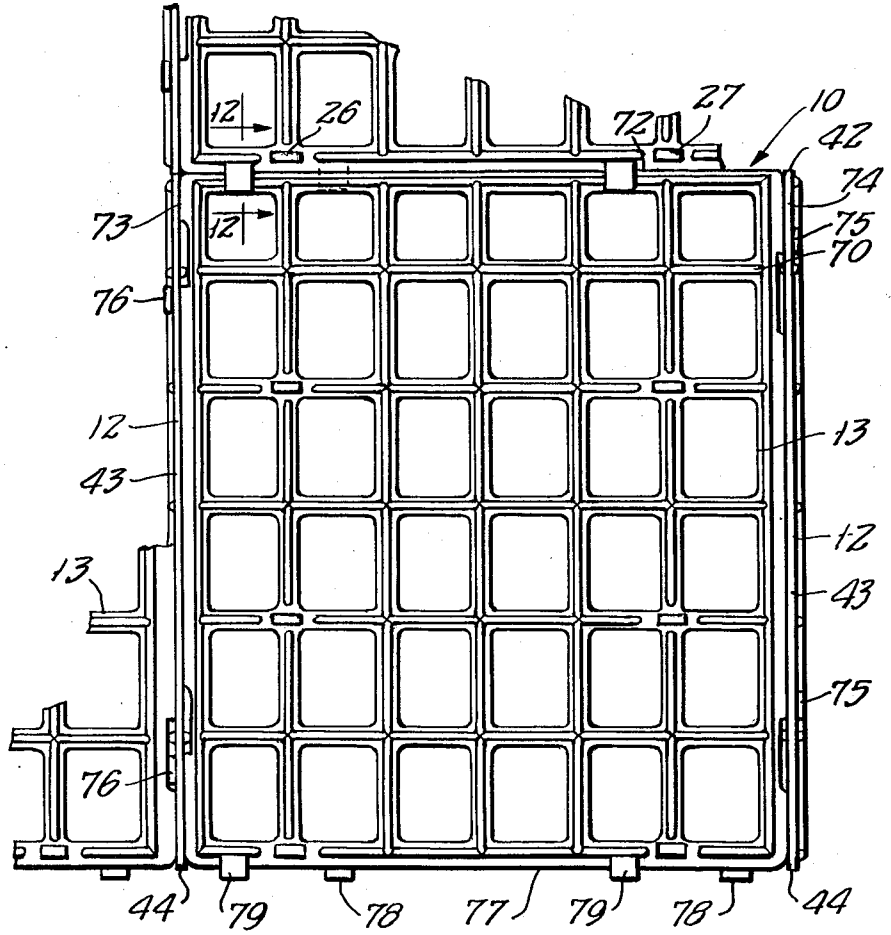
FIG. 4 is fragmentary rear elevational view thereof.
Figure 3:
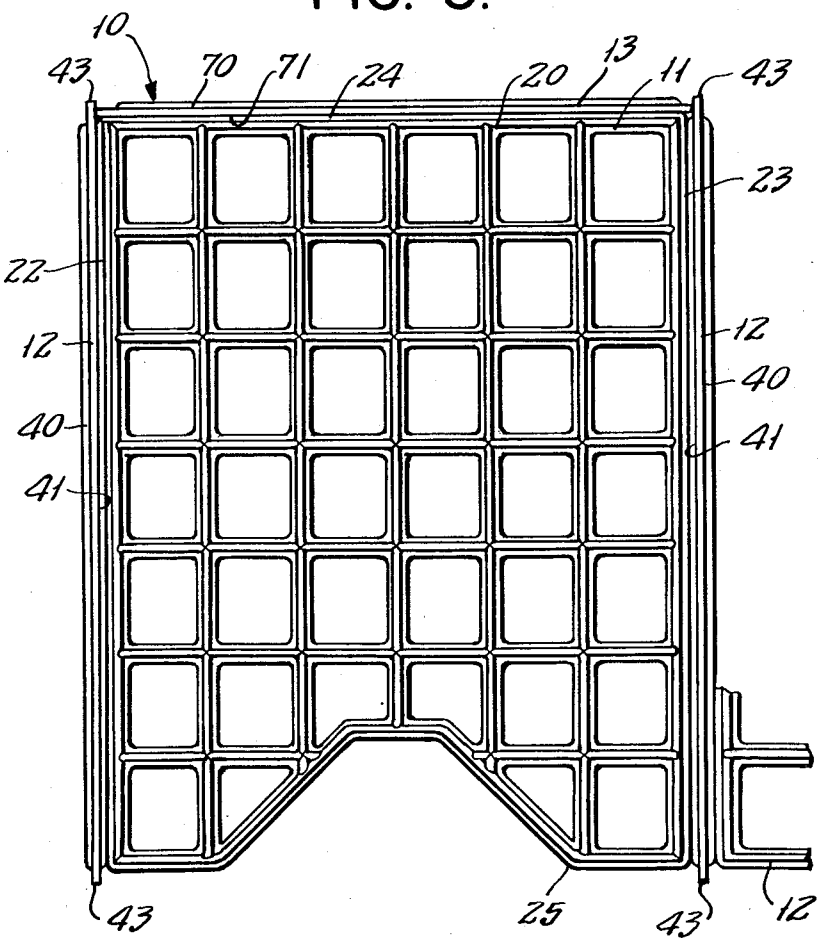
FIG. 3 is a fragmentary top plan view thereof.

In accordance with the invention, the device, generally indicated by reference character 10 comprises broadly: a first plurality of floor members 11, a second plurality of sidewalls members 12, and a third plurality of rear wall members, all of the members 11–13 preferably formed from injection molded synthetic resinous material and each being provided with corresponding tongue and groove interconnecting means 14 and 15.

The floor members 11 form generally horizontally oriented material-supporting parts of the device, and are of generally rectangular planar configuration, being bounded by an upper surface 20, a lower surface 21, first and second side edges 22 and 23, rear edges 24, and front edges 25. The interconnecting means includes first and second rear tabs 26 and 27, and first and second left hand tabs at 20 and 29, which are in non-symmetrical relation with respect to first and second right hand tabs 30 and 31.

The side wall members 12 are adapted to be engaged by corresponding floor and rear wall members from either of two surfaces, and except for stacking tabs along a lower edge thereof, they are devoid of other tabs. Each side wall member is bounded by first and second planar surfaces 40 and 41 an upper edge 42, a pair of vertical edges 43 and a lower edge 44. Adjacent the vertical edges 43 are superimposed pairs of first, second and third slots 46,47 and 48; and fourth, fifth and sixth sets of slots 50,51 and 52, respectively. The sets 46–48, and the sets 50–52 are stacked in vertical alignment to accommodate engaging tabs on the floor members 11 adjacent the front and rear portions thereof. Disposed substantially at the vertical edges 43 are first and second upper slots 56 and 57, and first and second lower slots 58 and 59 to provide for engagement of rear wall members 13. It will be noted, that normally only one set of these slots will be employed at any given time, but the provision of an oppositely disposed set permits that a device to be assembled without regard to whether a vertical edge is "front" or "rear".

The rear wall members 13, again, includes first and second planar surfaces 70 and 71 and upper edge 72, first and second side edges 73 and 74 which support non-symmetrically disposed tabs 75 and 76, respectively. A lower edge 77 is provided with downwardly extending tabs 78 and 79 on either one of the first and second planar surfaces 70 and 71, to form a means for stackably arranging the rear wall members 13 in vertical orientation. These correspond to corresponding structures 60 and 61 on the sidewall members 12. First, second and third pairs of slots 80, 81 and 82 respectively provide means for engaging the rear edge of the floor members 11.

Figure 7:
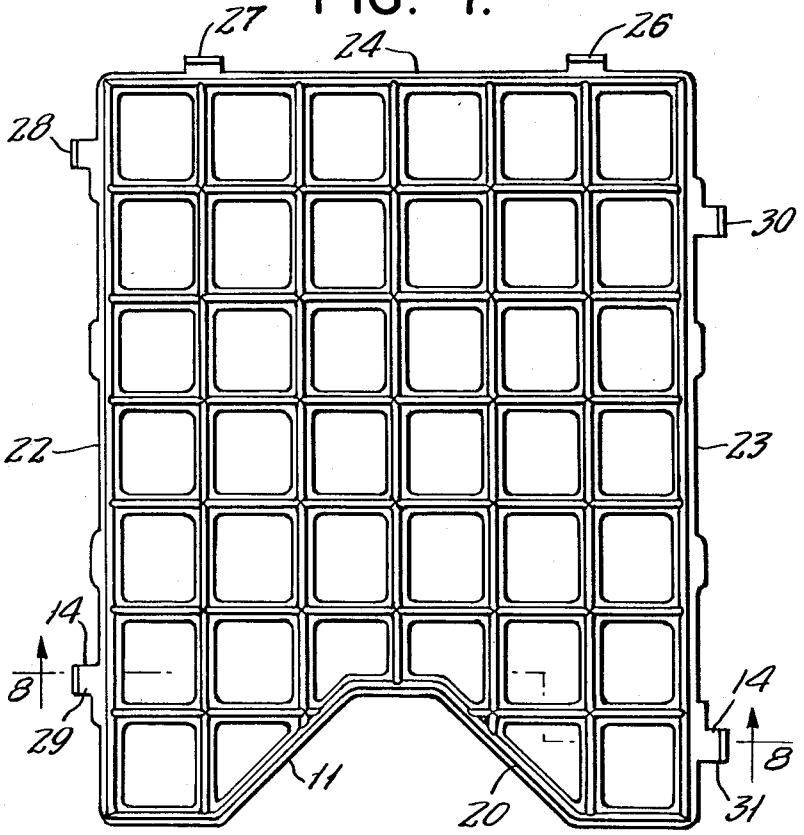
FIG. 7 is a view in elevation of a floor member forming a part of the disclosed embodiment.
Figure 8:
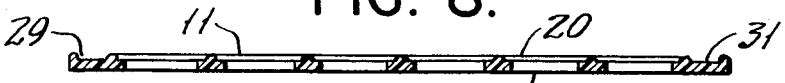
FIG. 8 is an offset sectional view as seen from the plane 8—8 in FIG. 7.
Figure 5:
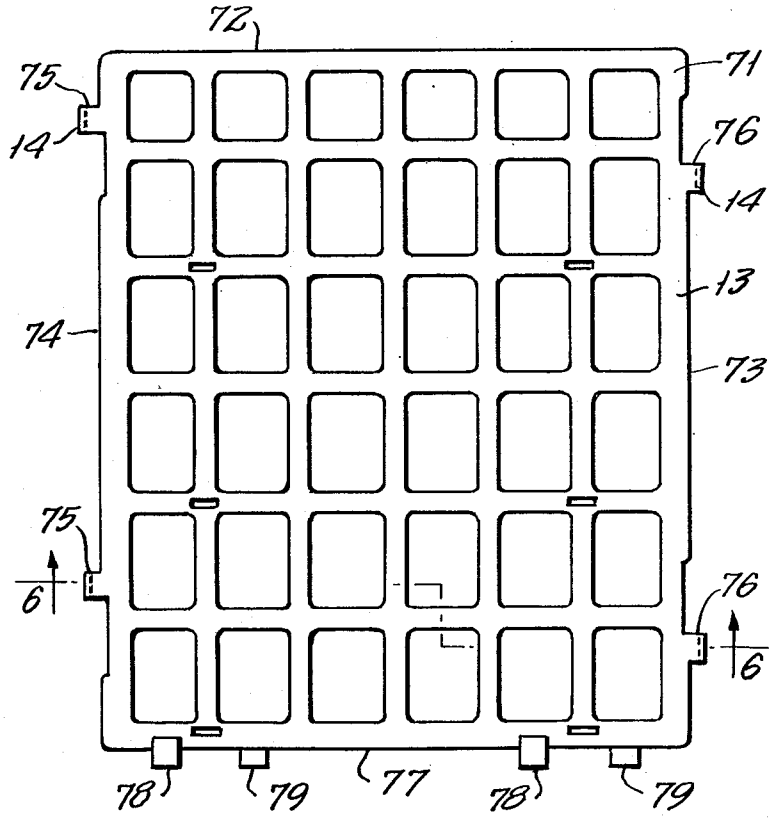
FIG. 5 is a view in elevation of a rear wall member forming another part of the embodiment.
Figure 6:
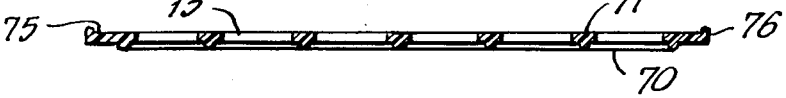
FIG. 6 is a sectional view as seen from the plane 6—6 in FIG. 5.
Figure 9:
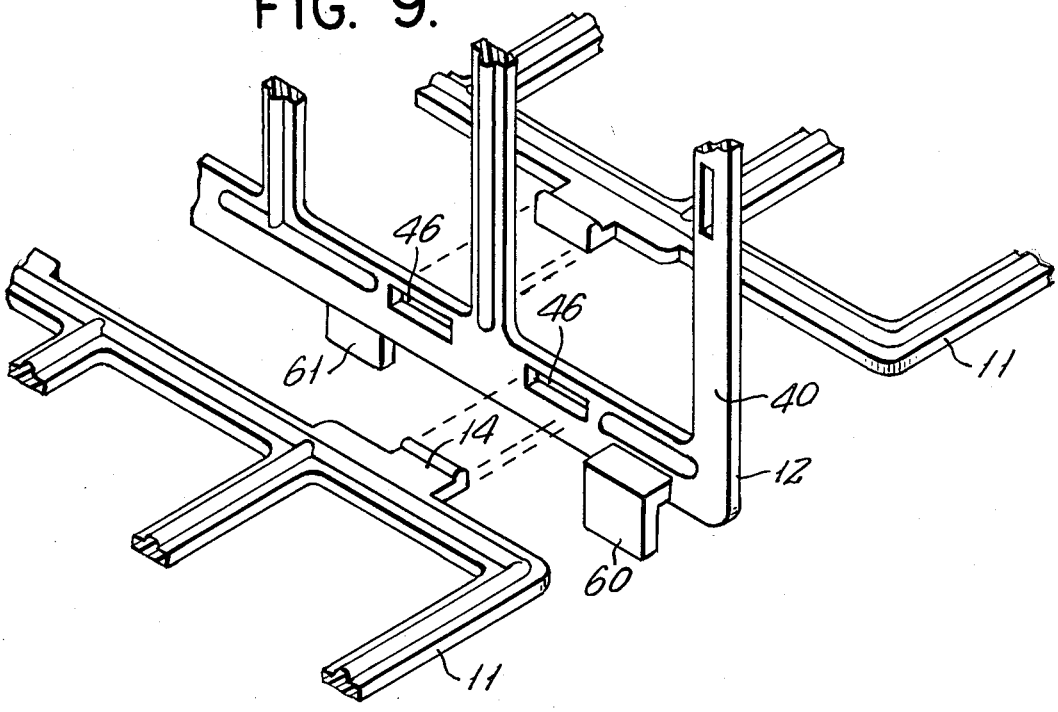
FIG. 9 is a fragmentary exploded view in perspective corresponding to the lower lefthand portion of FIG. 1.
Figure 10:
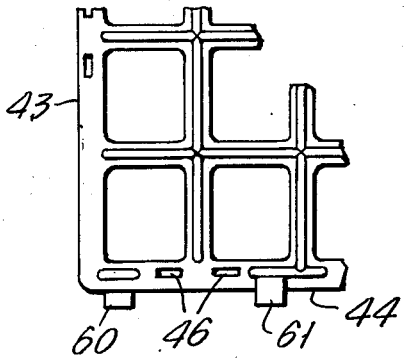
FIG. 10 is an enlarged fragmentary view in elevation corresponding to the lower lefthand portion of FIG. 2.
Figure 11:
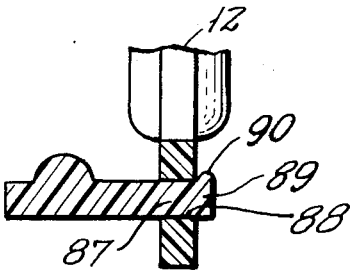
FIG. 11 is an enlarged fragmentary sectional view as seen fron the plane 11—11 in FIG. 5.
Figure 12:
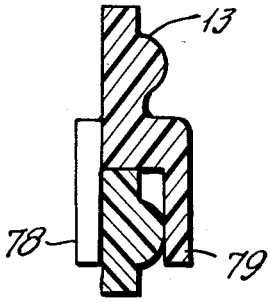
FIG. 12 is a fragmentary enlarged sectional view as seen from the plane 12—12 in FIG. 4.

Referring to FIGS. 7, there is illustrated an enlarged representation of the engagement of a typical tab and slot, the construction being substantially identical throughout. The base of the tab 87 is of a thickness generally corresponding to the width of a slot 88. However, the free end 89 is provided with a flange 90, which extends laterally from the plane of the tab, a distance sufficient so that the effective width of the tab at the free end thereof slightly greater than the width of the slot 88. Thus, when the former is pressed into engagement with the latter, the plastic material bordering the slot is distorted to permit passage of the tab which occurs with a snap-like action. Once engaged, there is little if any play existing between the tab and the slot, and it is this feature which causes engaged parts to remain substantially at a mutual right angle, thereby facilitating further assembly including the attachment of the remaining parts.

I wish it to be understood that I do not consider the invention to be limited to the precise details of structure shown and set forth in this specification, for obvious modifications will occur to those skilled in the art to which the invention pertains.

I claim:

1. Stationery rack construction comprising: a first plurality of floor members of generally planar configuration, a second plurality of side wall members of generally planar rectangular configuration, and a third plurality of rear wall members of generally planar rectangular configuration; said first, second and third pluralities being formed of moulded synthetic resinous material and having a limited degree of resiliency; said first plurality of floor members having a pair of opposed side edges having planar laterally projecting tabs thereon in mutually non-symmetrical relation, said second plurality of side wall members having plural sets of first and second slots at correspondingly disposed locations so as to be selectively engageable with projections on said first plurality of floor members on one side thereof in said first slots, and on the oppositely disposed sides thereof by projections in said second slots thereof; whereby a number of members of said first plurality of floor members may be engaged upon either side of a single member of said second plurality of side wall members, enabling said single member to serve selectively as an end wall or a medially disposed wall of said rack construction.

2. Structure in accordance with claim 1, further characterized in said first plurality of floor members having rearwardly extending tabs, said second plurality of side members also having rearwardly extending tabs, said third plurality of rear wall members having corresponding slots selectively engageable with said rearwardly extending tabs of said first and second plurality of members, whereby to provide for mutual assembly of said first, second and third pluralities to form a rectangularly shaped enclosure.

3. Stationery rack construction in accordance with claim 2, further characterized in said tabs each having a terminal portion thereof of increased width relative to the remaining portions thereof, which upon engagement of a corresponding slot resiliently spreads said slot to provide a snap action.

4. Structure in accordance with claim 2, further characterized in each of said second and third pluralities of members having downwardly projecting tabs on either side of lower edges thereof for selective engagement with corresponding upper edges of like pluralities to provide for the stacking of said second and third pluralities during assembly.

* * * * *